US005582301A

United States Patent [19]

Josephson

[11] Patent Number: 5,582,301

[45] Date of Patent: Dec. 10, 1996

[54] BRACKET ADAPTED TO SUPPORT REVOLVABLE TUBULAR-SHELL TYPE EYEGLASSES DISPLAY FROM UPRIGHT MULTIPERFORATE PEGBOARD

[76] Inventor: Lawrence B. Josephson, 9465 Dewey Ave., Omaha, Nebr. 68114

[21] Appl. No.: 338,236

[22] Filed: Nov. 14, 1994

[51] Int. Cl.[6] ..... A47F 7/00

[52] U.S. Cl. ..... 211/13; 211/163

[58] Field of Search ..... 211/95, 106, 87, 211/163, 13; 248/902, 220.42, 220.43, 220.31

[56] References Cited

U.S. PATENT DOCUMENTS

| | | | |
|---|---|---|---|
| 2,950,155 | 8/1960 | Schick | 211/163 |
| 2,972,420 | 2/1961 | Tucci | 211/95 |
| 3,195,736 | 7/1965 | Bombar, Jr. | 211/163 |
| 5,228,582 | 7/1993 | Marshall et al. | 211/95 |
| 5,257,703 | 11/1993 | Ascik et al. | 211/13 |

FOREIGN PATENT DOCUMENTS

| | | | |
|---|---|---|---|
| 2266480 | 10/1975 | France | 211/13 |
| 17766 | 8/1908 | United Kingdom . | |

*Primary Examiner*—Leslie A. Braun
*Assistant Examiner*—Willie Berry, Jr.
*Attorney, Agent, or Firm*—George R. Nimmer

[57] ABSTRACT

For the purposes of vendably displaying eyeglasses from a radiating-arms tubular-shell revolvable about a vertical-axis shaft, disclosed are vertically-pairable and pegboard-engageable brackets, each such bracket including: an upright annulus intersected by an upright central-plane; attachably extending uprightly from the annulus rear-plane, a plurality of primary upright-bars respectively adaptable to be removably secureable through pegboard horizontally-aligned perforations and a pair of secondary upright-bars spatially-similarly flanking a said upright central-plane; and a pair of overlying horizontal rings located forwardly of the pegboard and together adapted to revolvably journal a said vertical-axis shaft, and said respective rings being attached to forwardly extending support-arms respectively topically connected to secondary upright-bars through forwardly-convergent horizontal connector-bars.

2 Claims, 2 Drawing Sheets

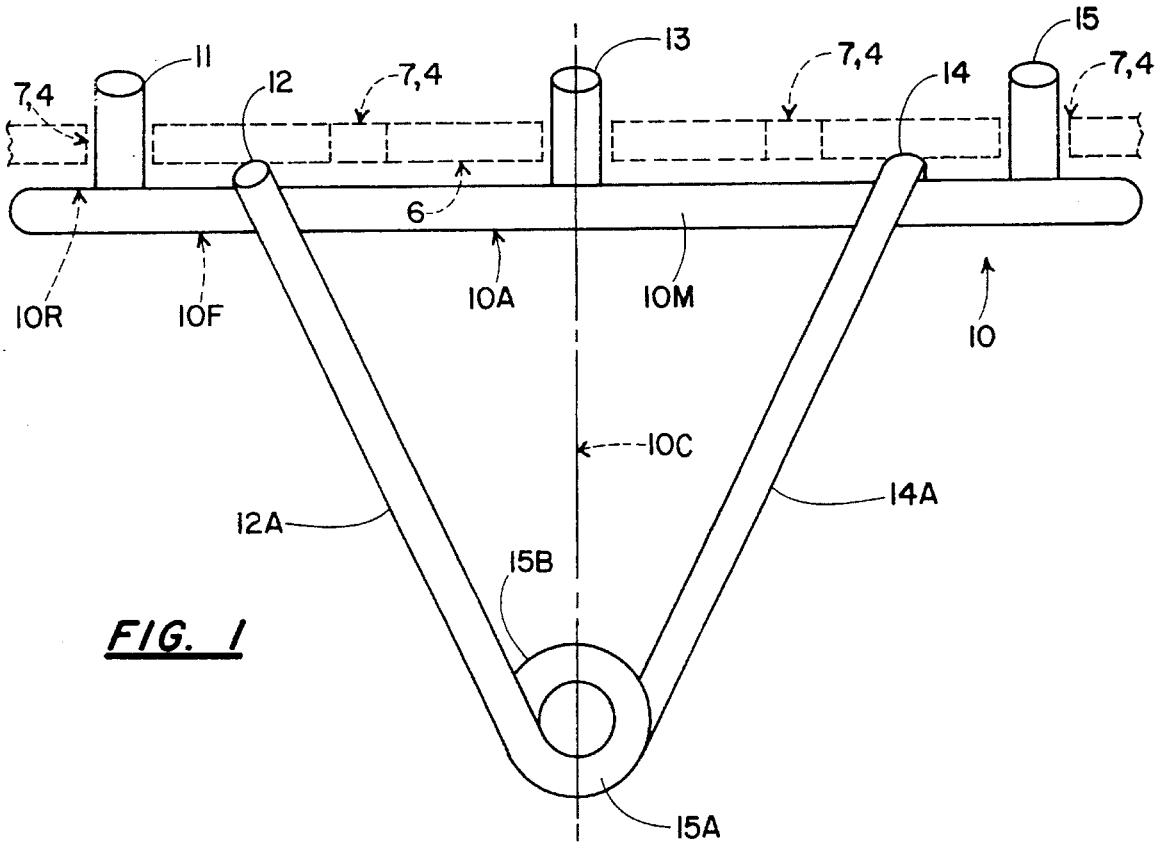
FIG. 1
FIG. 2
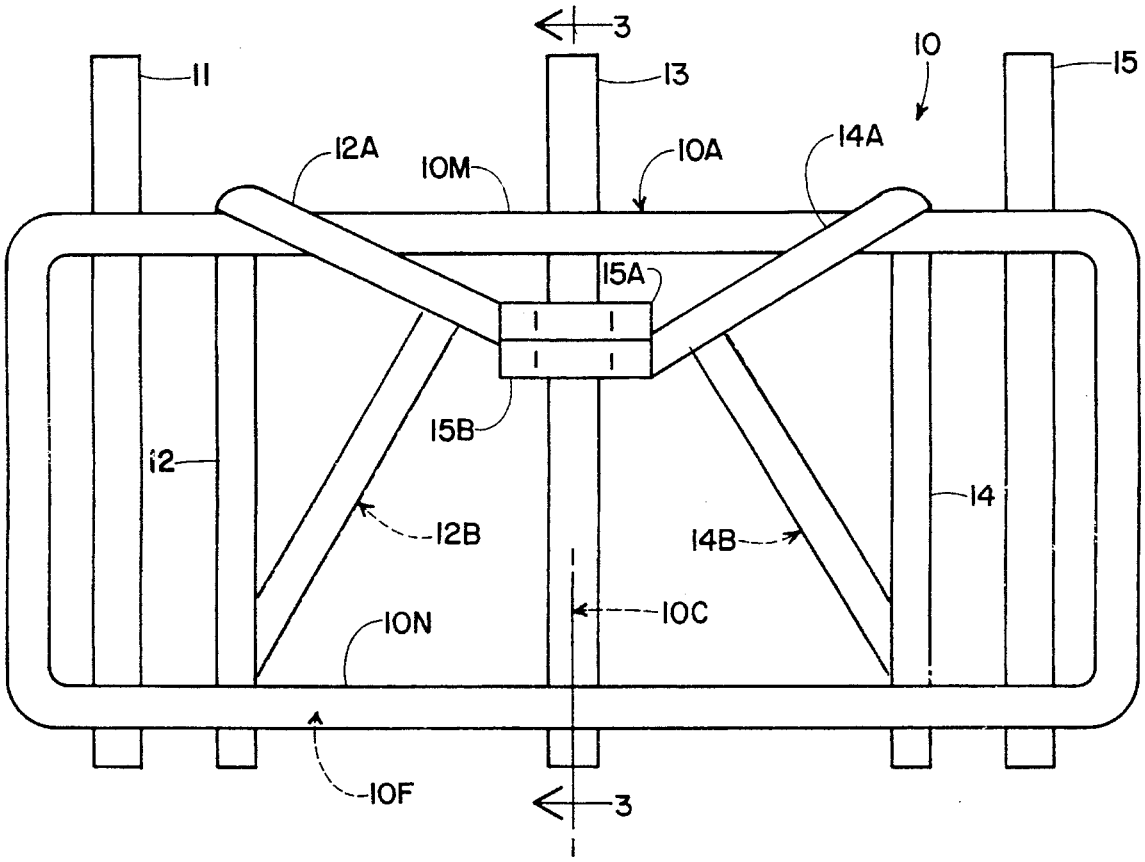

BRACKET ADAPTED TO SUPPORT REVOLVABLE TUBULAR-SHELL TYPE EYEGLASSES DISPLAY FROM UPRIGHT MULTIPERFORATE PEGBOARD

BACKGROUND OF THE INVENTION

For the purposes of retailably displaying eyeglasses (or other analagous vendable items), the prior art teaches an upright tubular-shell (provided with a plurality of items displaying horizontal radial-arms) and which tubular-shell revolvably surrounds a vertical-axis shaft equipped with a lower-base stabilizeably implantable upon a horizontal tabletop environment. However, tabletop environments spatially-intrude upon spatially-limited retailing environments.

GENERAL OBJECTIVE OF THE INVENTION

Upright walls being less spatially-intrusive than horizontal tabletops within spatially-limited retailing environments, it is the general objective of the present invention to revolvably support upright tubular-shells (equipped with a plurality of items-displaying horizontal radial-arms) from a retailing environment upright wall (e.g. wherein the upright wall takes the form of a horizontally multi-perforate upright pegboard wall).

GENERAL STATEMENT OF THE INVENTION OBJECTIVE

The aforementioned general objective of the present invention to provide an upright wall (e.g. a horizontally multi-perforate upright pegboard) retailing environment for a revolvable upright shell (provided with a plurality of items-displaying horizontal radial-arms), and which revolvable upright-shell revolvably surrounds a vertical-axis shaft, and said vertical-axis shaft being herein revolvably surrounded by the horizontally-overlying and vertically-disposed forward rings (e.g. 15A, 15B) of respective overlying pegboard-secured bracket supports (e.g. 10J, 10K) to a vertical-axis shaft (110) for a radiat-arms tubular-shaft display (100) for vendably displayable eyeglasses.

BRIEF DESCRIPTION OF THE DRAWING

In the drawing, wherein like characters refer to like parts in the several views, and in which:

FIG. 1 is a top plan view of a representative embodiment of a bracket (e.g. 10) that is dually employable, in forwardly-offset vertical-alignments from a horizontally-multiperforate (7) upright pegboard (9) to thereby support the vertical-axis shaft (110, 111) of a tubular shell type (120) retailing display (100) of customer selectable eyeglasses;

FIG. 2 is a frontal elevational view of the FIG. 1 representative bracket embodiment (10)

DETAILED DESCRIPTION OF THE DRAWING

Figure 3:
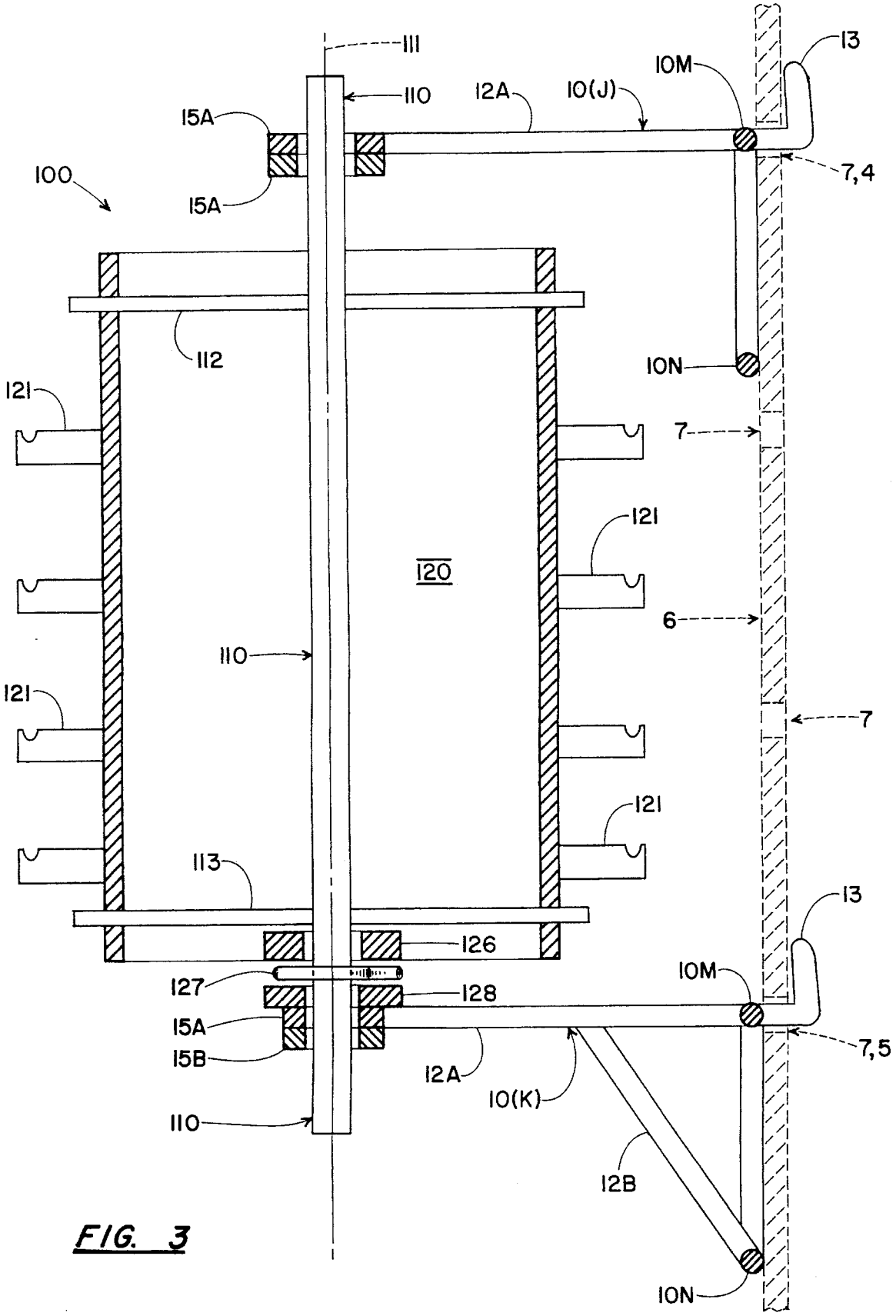
FIG. 3 is a sectional elevational view, taken along line 3—3 of FIG. 2, which generally schematically indicates a duality of such novel brackets (e.g. 10) together employed for supporting the vertical-axis shaft (110, 111) for an eyeglasses display (e.g. 100) from vertically-distinct levels (4, 5) of an upright and horizontally-multiperforate (7) upright pegboard (9).

Turning initially to the aforedescribed drawing FIGS. 1 and 2, each such similarly employable-novel bracket (10) comprises, (i) an uprightly extending skeletal annulus (10A) lying along an upright front-plane (10F) that is parallel to an annulus upright rear-plane (10R), and which upright-planes (10F, 10R) are intersected by a directionally front-to-rear upright central-plane (10C);

(ii) attachably uprightly extending along rear-plane (10R) from the horizontal upper-length (10M) and the horizontal lower-length (10N) of annulus 10A are a plurality of upright-bars including a plurality of upright primary-bars (11, 13, 15) which are respectively adaptable to be upwardly removably securely insertable through horizontally-aligned perforations (7) of an upright pegboard (9) and also including upright secondary-bars (12, 14) spatially-similarly parallely flanking said upright central-plane 10C; and (iii) a pair of overlying horizontally-disposed rings (15A, 15B) and surroundable of elements 110; 111), located forwardly of annulus front-plane 10F at central-plane 10C and which rings (15A, 15B) are together adapted journal a said vertical-axis shaft (110, 111). Said adjacently overlying rings (15A, 15B) are respectively horizontally supported by a pair of forwardly-convergent forward support-bars (12A, 14A) respectively topically connected to said secondary upright-bars (12, 14).

As best seen in FIGS. 2 and 3, one of said novel brackets (e.g. 10K) is desireably optionally provideable with stiffener-bars (12B, 14B) respectively upwardly-forwardly extending from the annulus lower-extent (e.g. from secondary-bars 12, 14, adjacent annulus lower-length 10N) to medial locations of support-bars (12A, 14A).

In view of the foregoing description regarding brackets (10) and with further reference to the FIG. 3 combination description showing vertically-aligned pairs of such pegboard-secured brackets (10J, 10K) for revolvably jornalling (e.g. at 15A, 15B) the vertical-axis shaft (110, 111) for a tubular-shell type (120) radiating-arms (121) type vendable-display device (100) for retailable eyeglasses: horizontal shell-bars (112, 113), connected between vertical-axis shaft 110 and tubular-shell 120 maintain the vertical-elevation between shaft 100 and tubular-shell 120; and there are means for maintaining the vertical elevation between vertical-axis shaft 110 and the respective vertically-aligned pegboard-engageable brackets (10J, 10K). In the latter regard, such means might be rudimentally accomplished by: placing immediately below a lower shell-bar 113 an upper-washer 126; placing immediately above the upper-ring 15A of a lower-bracket 10K, a lower-washer 128, and both said washers surrounding vertical-axis shaft 110; and together with a separational cotter-pin (127) intersecting such vertical-axis shaft 110 between the elevations of said washers 126 and 128. More sophisticated vertical-elevational means between the vertical-axis shaft and radiating-arms tubular-shell are intended to be encompassed by the claims of this invention.

From the foregoing, the construction and operation of the "bracket adapted to support revolvable tubular-shell type eyeglasses display from upright horizontally-multiperforate pegboard" will be readily understood and further explanation is believed to be unnecessary. However, since numerous modifications and changes will readily occur to those skilled in this art, it is not desired to limit the invention to the exact construction shown and described, and accordingly, all suitable modifications and equivalents may be resorted to, and falling within the scope of the appended claims.

I claim:

1. For the purpose of dually, forwardly offsettably-supporting from perforate upper-level and lower-level locations at the upright frontal vertical-surface of an upright and horizontally-perforate peg-board, the vertical-axis shaft for a tubular-shell type display of removably selectable eyeglasses, a pair of independently vertically alignable pegboard-to-shaft brackets, and each such pegboard vertically alignable bracket comprising:

(i) an upright annulus lying along an upright front-plane and also along an upright rear-plane, and which front-plane and rear-plane are perpendicularly intersected by an upright central-plane; and (ii) attached to and extending uprightly along the upright annulus rear-plane, a plurality of upright-bars including a plurality of primary upright-bars respectively provided with upstanding prongs adaptable to be removably and upwardly securely insertable through environmental pegboard perforate levels, and also including a pair of secondary upright-bars spatially-similarly flanking said upright central-plane; and (iii) a pair of overlying horizontal rings located forwardly of said front-plane and together adapted to revolvably support overlyingly therebetween a said vertical-axis shaft, and said respective rings being attached to horizontally, forwardly extending support-arms respectively topically connected to said upright secondary upright-bars through horizontal and forwardly-convergent connector-bars.

2. The retailing device combination of claim 1 wherein at lease the lower vertical aligned pegboard-to-shaft bracket is provided with stiffener-bars respectively upwardly-forwardly extending from said secondary-bars to attached medial locations of said horizontal and forwardly-convergent connector-bars.

* * * * *